US009306326B2

(12) United States Patent
Nishiyama et al.

(10) Patent No.: US 9,306,326 B2
(45) Date of Patent: Apr. 5, 2016

(54) CONNECTOR

(71) Applicant: YAZAKI CORPORATION, Minato-ku, Tokyo (JP)

(72) Inventors: Noritaka Nishiyama, Shizuoka (JP); Takeshi Osada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/418,992

(22) PCT Filed: Jul. 12, 2013

(86) PCT No.: PCT/JP2013/004310

§ 371 (c)(1),
(2) Date: Feb. 2, 2015

(87) PCT Pub. No.: WO2014/020841

PCT Pub. Date: Feb. 6, 2014

(65) Prior Publication Data

US 2015/0214658 A1 Jul. 30, 2015

(30) Foreign Application Priority Data

Aug. 2, 2012 (JP) ..... 2012-171928

(51) Int. Cl.

| | |
|---|---|
| ***H01R 13/514*** | (2006.01) |
| ***H01R 13/627*** | (2006.01) |
| ***H01R 13/436*** | (2006.01) |
| ***H01R 13/641*** | (2006.01) |
| ***H01R 24/76*** | (2011.01) |
| *H01R 13/11* | (2006.01) |
| *H01R 13/422* | (2006.01) |

(52) U.S. Cl.

CPC ..... *H01R 13/6272* (2013.01); *H01R 13/4362* (2013.01); *H01R 13/641* (2013.01); *H01R 24/76* (2013.01); *H01R 13/113* (2013.01); *H01R 13/4223* (2013.01)

(58) Field of Classification Search

CPC ..... H01R 13/4362; H01R 13/4361; H01R 4/185; H01R 13/432; H01R 13/642

USPC ..... 439/752

See application file for complete search history.

(56) References Cited

U.S. PATENT DOCUMENTS

| | | | | |
|---|---|---|---|---|
| 4,891,021 | A * | 1/1990 | Hayes | H01R 13/114 439/595 |
| 4,959,023 | A * | 9/1990 | Watanabe | H01R 13/4361 439/594 |
| 5,183,418 | A * | 2/1993 | Yamanashi | H01R 13/4368 439/595 |
| 5,851,128 | A | 12/1998 | Nakata et al. | |
| 2003/0060075 | A1 | 3/2003 | Nakamura et al. | |

FOREIGN PATENT DOCUMENTS

| | | |
|---|---|---|
| EP | 0723312 A2 | 7/1996 |
| JP | 3804489 B2 | 5/2006 |

* cited by examiner

*Primary Examiner* — Phuong Dinh
(74) *Attorney, Agent, or Firm* — Mots Law, PLLC

(57) ABSTRACT

A connector (1) includes a connector housing (2), a terminal (3) received in a terminal reception chamber (21), and a retainer (4) inserted in a retainer insertion hole (22) of the connector housing (2) and configured to shift between a terminal insertion allowable position and a terminal fit position. A terminal locking protrusion (47) of the retainer (4) has a base protrusion (45) configured to come in contact with a rear wall (31*b*) of an opposite terminal connection part (31) of the terminal (3) with the retainer (4) being in the terminal fit position, and a tip end protrusion (46) provided on an enter-side face of the base protrusion (45) and configured to enter space inside a connection part (33) of the terminal (3) with the retainer (4) being in the terminal fit position.

1 Claim, 8 Drawing Sheets

CONNECTOR

TECHNICAL FIELD

The present invention relates to a connector including terminals inserted and double-locked in a connector housing.

BACKGROUND ART

A connector in which terminals are double-locked is proposed in Patent Literature 1.

As such, a connector shown in FIG. 1 and FIGS. 2A and 2B has been known. As shown in FIG. 1, a connector 100 includes a connector housing 120 and a retainer 130. The connector housing 120 includes terminal reception chambers 121 receiving a plurality of terminals 110 and a retainer insertion hole 122 opening into the terminal reception chambers 121. The retainer 130 is inserted in a direction orthogonal to the terminal reception chambers 121 inside the retainer insertion hole 122. Each of the terminals 110 includes an opposite terminal connection part 111 connected to an opposite terminal (not shown), an electric wire connection part 112 connected to an electric wire (not shown), and a connection part 113 connecting the opposite terminal connection part 111 and the electric wire connection part 112 together. Each of the terminal reception chambers 121 has a flexible locking lance 123 formed integrally with and protrusively from its lower wall. The flexible locking lance 123 is locked to a locking claw 111*a* of the terminal 110 to prevent the movement (backward falling-out) of the terminal 110 in a direction opposite to a direction at insertion. In addition, the retainer 130 is locked to a rear wall 111*b* of the opposite terminal connection part 111 to prevent the movement (backward falling-out) of the terminal 110 in the direction opposite to the direction at the insertion.

Here, a procedure for assembling the terminal of the connector 100 will be described. First, the retainer 130 is set in a terminal insertion allowable position (position in FIGS. 2A and 2B). In the terminal insertion allowable position, a terminal locking protrusion 131 of the retainer 130 is arranged outside the terminal reception chamber 121. Next, the terminal 110 is inserted in the terminal reception chamber 121. When the terminal 110 is inserted in its terminal fit position, the flexible locking lance 123 is locked to the rear wall 111*b* of the opposite terminal connection part 111 of the terminal 110 as shown in FIG. 1. Then, the retainer 130 is moved from the terminal insertion allowable position to the terminal fit position. In the terminal fit position of the retainer 130, the bottom face of the retainer 130 becomes substantially flush with that of the connector housing 120. The terminal 110 is double-locked by the flexible locking lance 123 and the retainer 130.

In addition, when the terminal 110 is inserted only in the semi-fit position of the connector housing 120 (position shown in FIGS. 2A and 2B), the movement of the retainer 130 from the terminal insertion allowable position to the terminal fit position is not allowed and thus the terminal insertion allowable position is maintained. That is, in this case, the bottom face of the retainer 130 protrudes from the connector housing 120 to an outside.

For confirmation as to whether the terminal 110 is in its semi-fit state, the presence or absence of the protrusion of the retainer 130 is detected after the assembly of the connector 100.

CITATION LIST

Patent Literature

[PTL1] JP 3804489 B1

SUMMARY OF INVENTION

Meanwhile, in the above related art, a protrusion amount L2 of the retainer 130 is relatively small and becomes equal to nearly the thickness of the rear wall 111*b* of the opposite terminal connection part 111. This is because, when the protrusion amount of the retainer 130 becomes greater than the rear wall 111*b* of the opposite terminal connection part 111, the bottom face of the retainer 130 protrudes from that of the connector housing 120 in the terminal fit position of the retainer 130. Accordingly, it is difficult to reliably confirm whether the terminal 110 is in the semi-fit state.

It is an object of the present invention to provide a connector that makes it possible to reliably confirm whether terminals inserted in a connector housing are in their semi-fit state.

A connector in accordance with some embodiments includes a connector housing having a terminal reception chamber and a retainer insertion hole opening into the terminal reception chamber, a terminal received in a terminal reception chamber by insertion, the terminal having an opposite terminal connection part connected to an opposite terminal, an electric wire connection part connected to an electric wire, and a connection part arranged between the opposite terminal connection part and the electric wire connection part, and a retainer inserted in the retainer insertion hole, having a terminal locking protrusion, and configured to shift between a terminal insertion allowable position and a terminal fit position. The terminal locking protrusion in the terminal insertion allowable position is arranged outside the terminal reception chamber to allow an insertion of the terminal in the terminal reception chamber. The terminal locking protrusion in the terminal fit position protrudes inside the terminal reception chamber and is locked to a rear wall of the opposite terminal connection part of the terminal to prevent a movement of the terminal in a direction opposite to an insertion direction of the terminal. The terminal locking protrusion has a base protrusion configured to come in contact with the rear wall of the opposite terminal connection part of the terminal with the retainer being in the terminal fit position, and a tip end protrusion provided on an enter-side face of the base protrusion and configured to enter space inside the connection part of the terminal with the retainer being in the terminal fit position.

According to the above configuration, in a state in which the terminal is in its fit state, the base protrusion of the retainer is locked to the rear wall of the opposite terminal connection part, and the tip end protrusion of the retainer enters the space inside the connection part. Thus, the bottom face of the retainer becomes flush with that of the connector housing. In addition, in a state in which the terminal is in its semi-fit state, the tip end protrusion of the terminal locking protrusion of the retainer is set outside the terminal reception chamber. Accordingly, the protrusion of the retainer is increased by a protrusion amount corresponding to the height of the tip end protrusion of the retainer compared with the related art, whereby the examination of the semi-fit state of the terminal may be accurately performed based on the position of the retainer. Thus, it is possible to reliably confirm whether the terminal inserted in the connector housing is in the semi-fit state.

DESCRIPTION OF EMBODIMENTS

Figure 1:
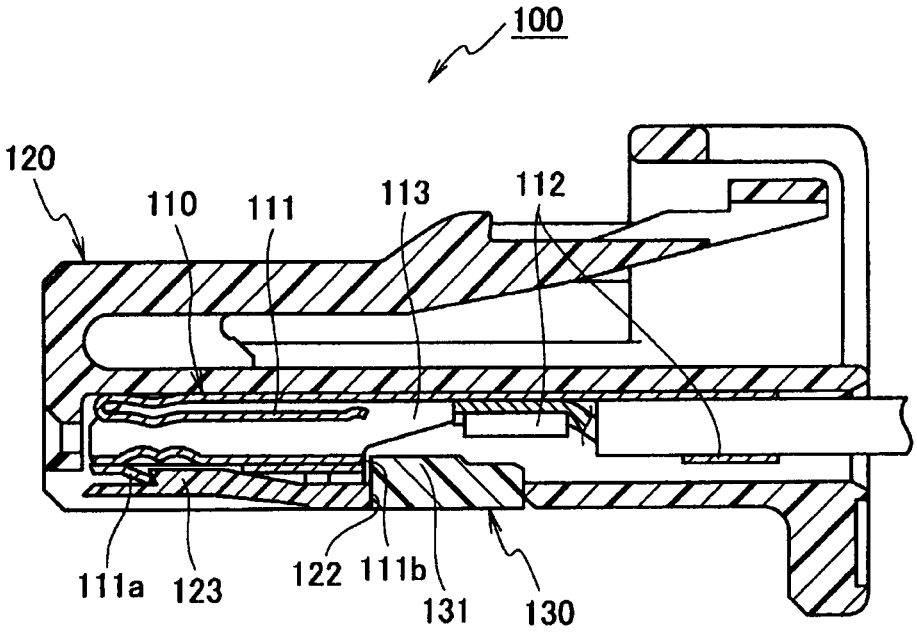
Fig. 1 Related Art
FIG. 1 illustrates a related art and is a cross-sectional view of a connector when a terminal is in its fit state.
Figure 2A:
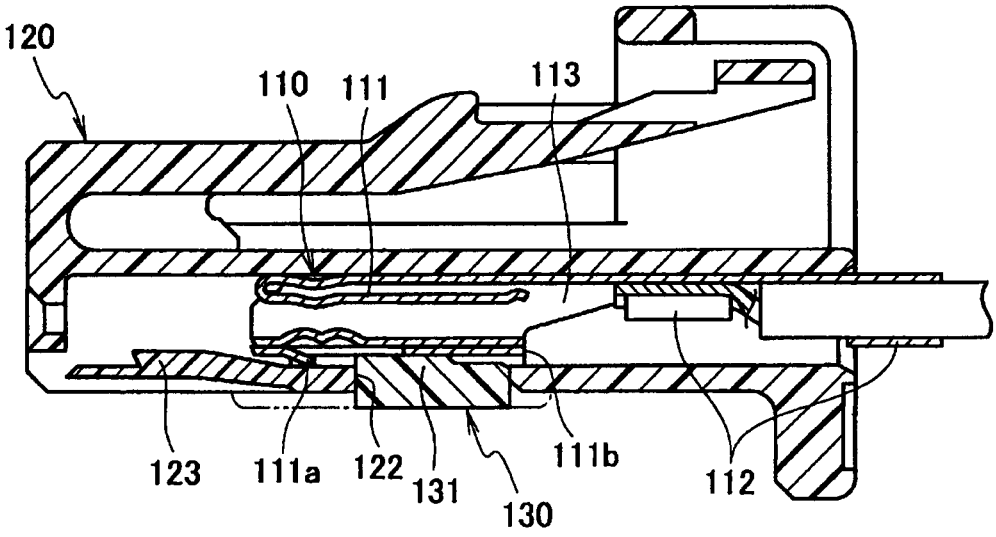
Fig. 2A Related Art
FIG. 2A illustrates the related art and is a cross-sectional view of the connector when the terminal is in its semi-fit state.
Figure 2B:
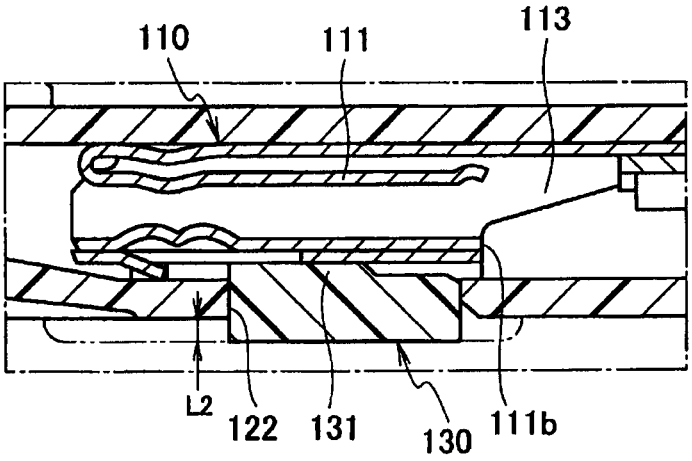
Fig. 2B Related Art
FIG. 2B is an enlarged view of a substantial part of FIG. 2A.
Figure 3:
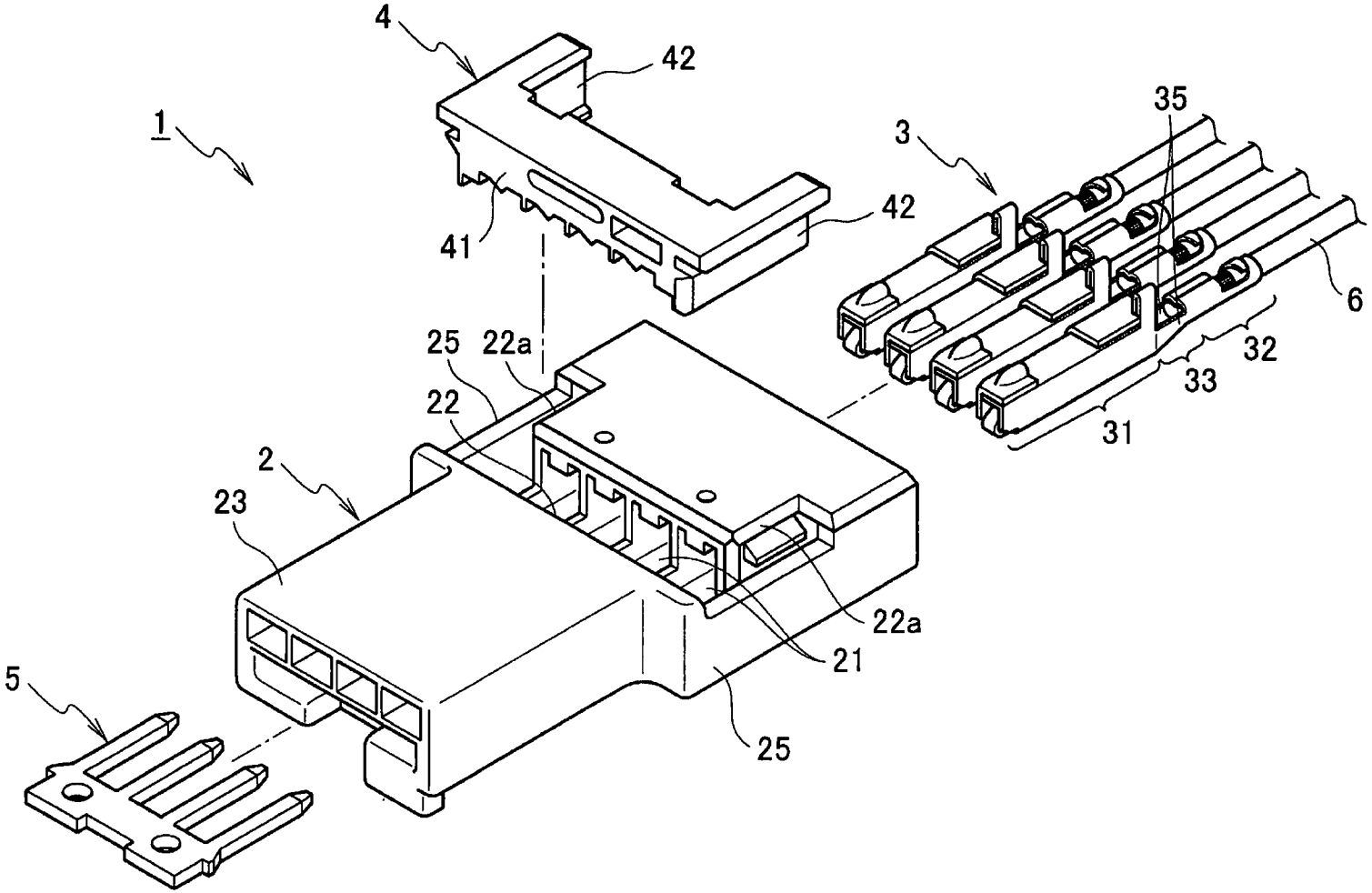
FIG. 3 is an exploded perspective view of a connector according to an embodiment of the present invention.
Figure 4:
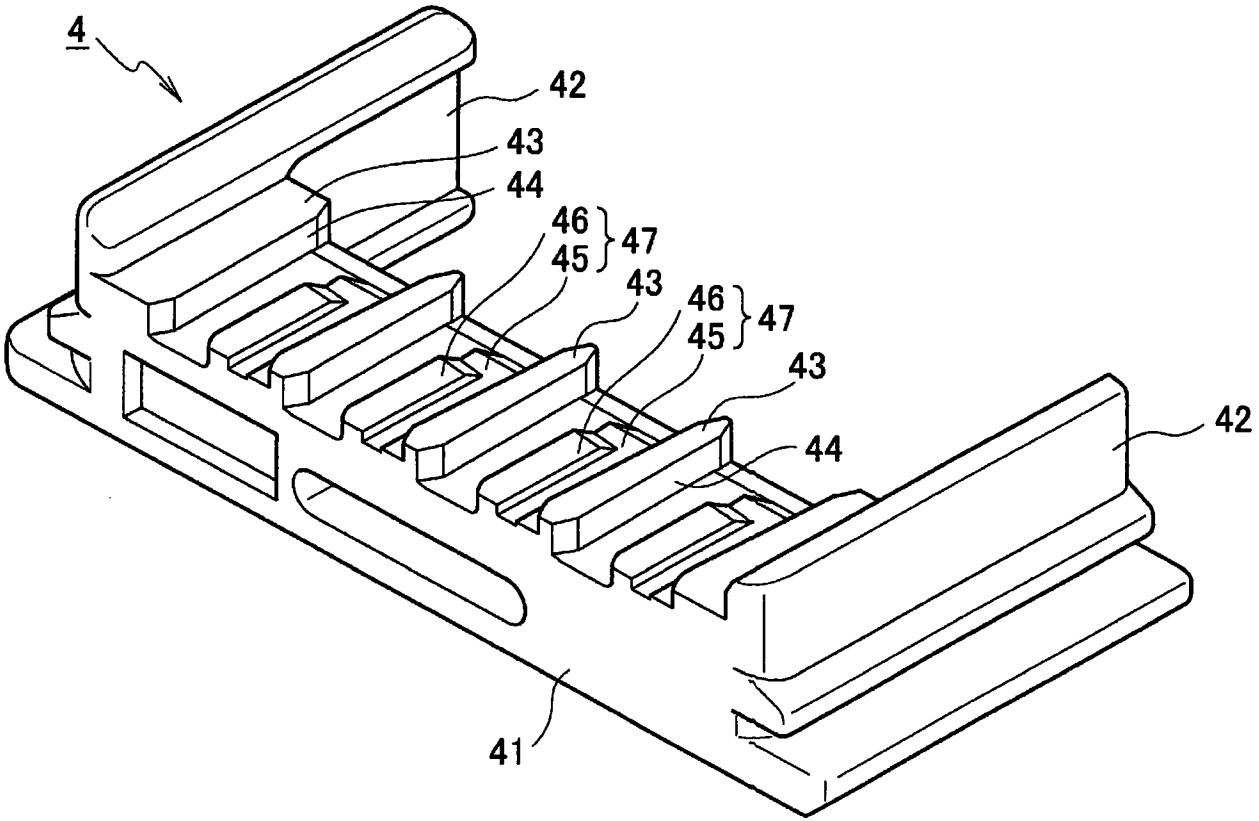
FIG. 4 is a perspective view of a retainer according to the embodiment of the present invention.

Hereinafter, an embodiment of the present invention will be described with reference to the drawings.

FIG. 3 to FIGS. 8A and 8B show the embodiment of the present invention. A connector 1 of the embodiment includes a connector housing 2 having a plurality of terminal reception chambers 21 and a retainer insertion hole 22 opening into the terminal reception chambers 21, a plurality of terminals 3 inserted and received in the respective terminal reception chambers 21, and a retainer 4 inserted in a direction orthogonal to the terminal reception chambers 21 inside the retainer insertion hole 22 of the connector housing 2.

The connector housing 2 is shaped roughly like a box with a synthetic resin material. A bottom plate 23 of the connector housing 2 has the retainer insertion hole 22 traversing the plurality of terminal reception chambers 21 and penetrating in the width direction of the connector housing 2. In addition, end parts 22*a* extending to a rear end side along side plates 25 of the connector housing 2 are provided at both right and left ends of the retainer insertion hole 22, respectively. On the front end side of the retainer insertion hole 22, a flexible locking lance 24 entering the terminal reception chambers 21 is formed integrally with and protrusively from the bottom plate 23 of the connector housing 2. The flexible locking lance 24 is locked to locking pieces 31*a* of opposite terminal connection parts 31 of the terminals 3, which will be described later, to prevent the movement of the terminals 3 in a direction opposite to a direction at insertion, i.e., the falling-out of the terminals 3 in a backward direction.

Each of the terminals 3 includes the opposite terminal connection part 31 connected to a joint terminal 5 serving as an opposite terminal, an electric wire connection part 32 connected to an electric wire 6, and a connection part 33 connecting the opposite terminal connection part 31 and the electric wire connection part 32 together. The connection part 33 includes a bottom face wall 34 and a pair of side face walls 35 extending upward from both ends of the bottom face wall 34. A tip end protrusion 46 of a terminal locking protrusion 47, which will be described later, enters space inside the pair of side face walls 35. A width W1 of the tip end protrusion 46 is set to be smaller than a width W2 between the inner faces of the pair of side face walls 35.

The retainer 4 is made of a synthetic resin material. The retainer 4 includes a base part 41, a pair of side wall parts 42, and partition wall parts 43. The base part 41 has a cross section similar to that of the retainer insertion hole 22 and is formed long. The pair of side wall parts 42 is provided at both ends in the longitudinal direction of the base part 41 and arranged inside the side plates 25 of the connector housing 2. The partition wall parts 43 protrude from the base part 41 toward the insertion direction (the upward direction in FIG. 4) of the retainer 4 and are provided between the pair of side wall parts 42 at prescribed intervals.

Each of the respective partition wall parts 43 extends in the insertion direction of the terminal 3. Between the adjacent partition wall parts 43, there is formed terminal reception spaces 44 connecting to each of the terminal reception chambers 21 in a state in which retainer 4 is inserted in the retainer insertion hole 22 of the connector housing 2.

In the terminal reception space 44, there is provided the terminal locking protrusion 47 protruding from the base part toward the insertion direction of the retainer 4 and including a base protrusion 45 and the tip end protrusion 46. The base protrusion 45 comes in contact with a rear wall 31*b* of the opposite terminal connection part 31 of the terminal 3 in a terminal fit position. The tip end protrusion 46 is provided on the enter-side face of the base protrusion 45 and enters the space inside the connection part 33 of the terminal 3 in the terminal fit position. The retainer 4 is inserted in the direction orthogonal to the terminal reception chamber 21 inside the retainer insertion hole 22 of the connector housing 2, and the terminal locking protrusion 47 of the retainer 4 comes in contact with the rear wall 31*b* of the opposite terminal connection part 31 of the terminal 3 received in the terminal reception chamber 21 to prevent the movement of the terminal 3 in the direction opposite to the direction at the insertion, i.e., the falling-out of the terminal 3 in the backward direction.

Figure 7:
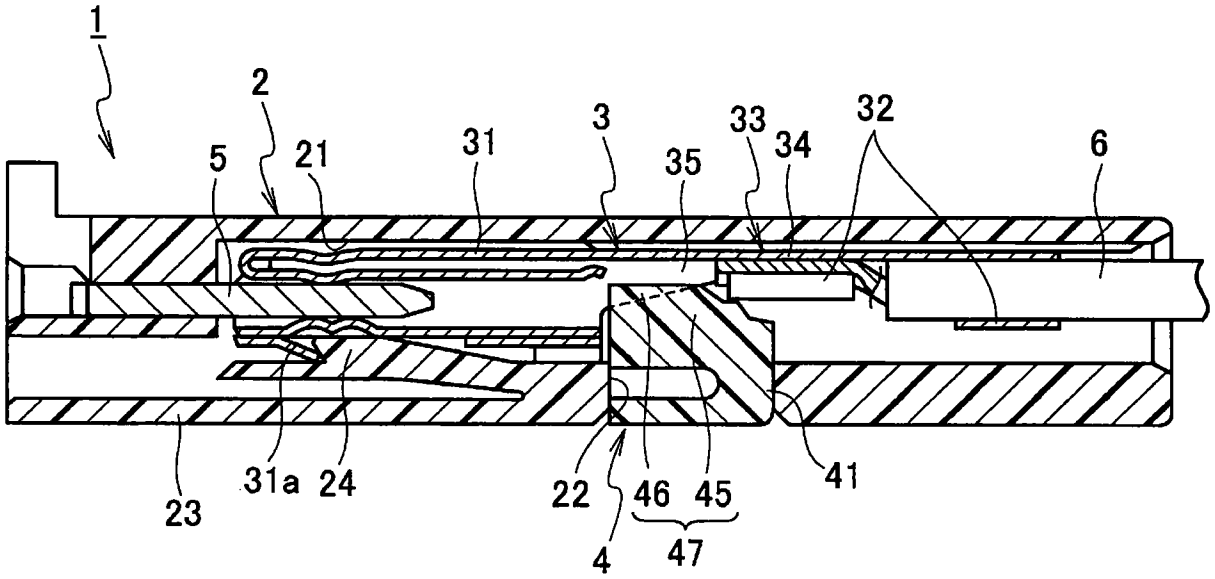
FIG. 7 is a cross-sectional view of the connector when the terminal is in its fit state according to the embodiment of the present invention.
Figure 8A:
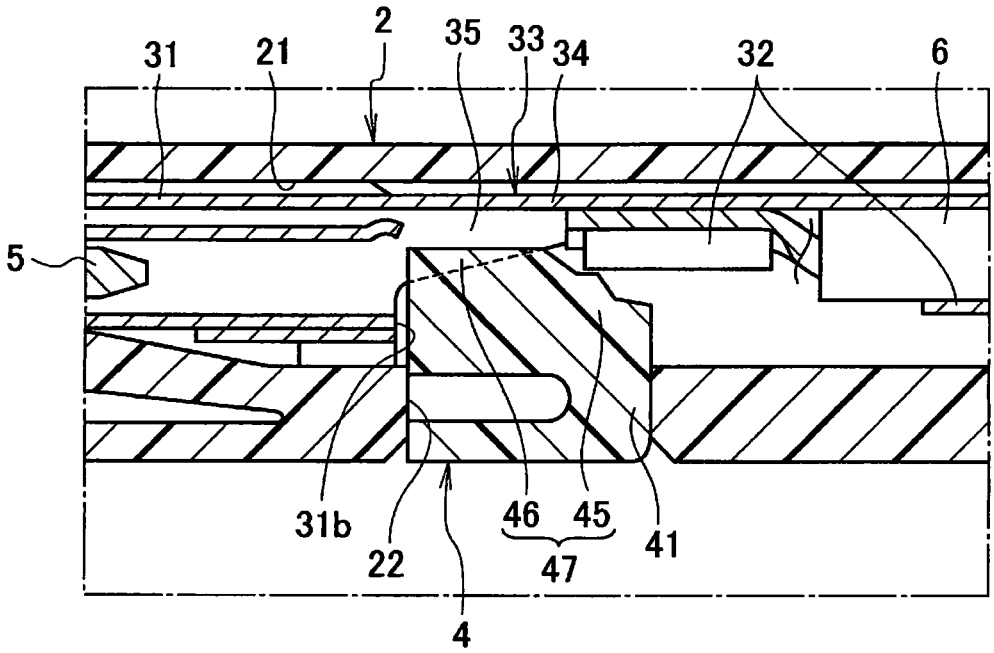
FIG. 8A is an enlarged view of a substantial part of FIG. 7.
Figure 8B:
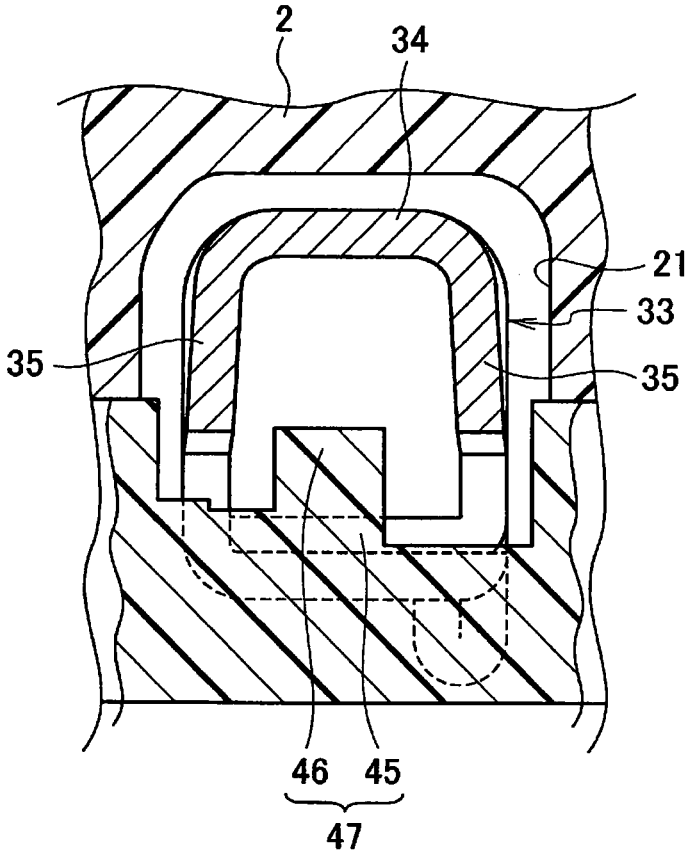
FIG. 8B is a vertical cross-sectional view of FIG. 7.

Here, a procedure for assembling the terminal of the connector 1 will be described. First, the retainer 4 is set in a terminal insertion allowable position (position in FIG. 5 and FIGS. 6A and 6B). In the terminal insertion allowable position, the terminal locking protrusion 47 of the retainer 4 is arranged outside the terminal reception chamber 21. Next, the terminal 3 is inserted in the terminal reception chamber 21. When the terminal 3 is inserted in the terminal fit position, the flexible locking lance 24 is locked to the opposite terminal connection part 31 of the terminal 3 as shown in FIG. 7 and FIGS. 8A and 8B. Then, the retainer 4 is moved from the terminal insertion allowable position to the terminal fit position. In the terminal fit position of the retainer 4, the bottom face of the retainer 4 becomes substantially flush with the bottom face 23 of the connector housing 2 and thus does not protrude from the bottom face 23 of the connector housing 2. The terminal 3 is double-locked by the flexible locking lance 24 and the retainer 4.

Figure 5:
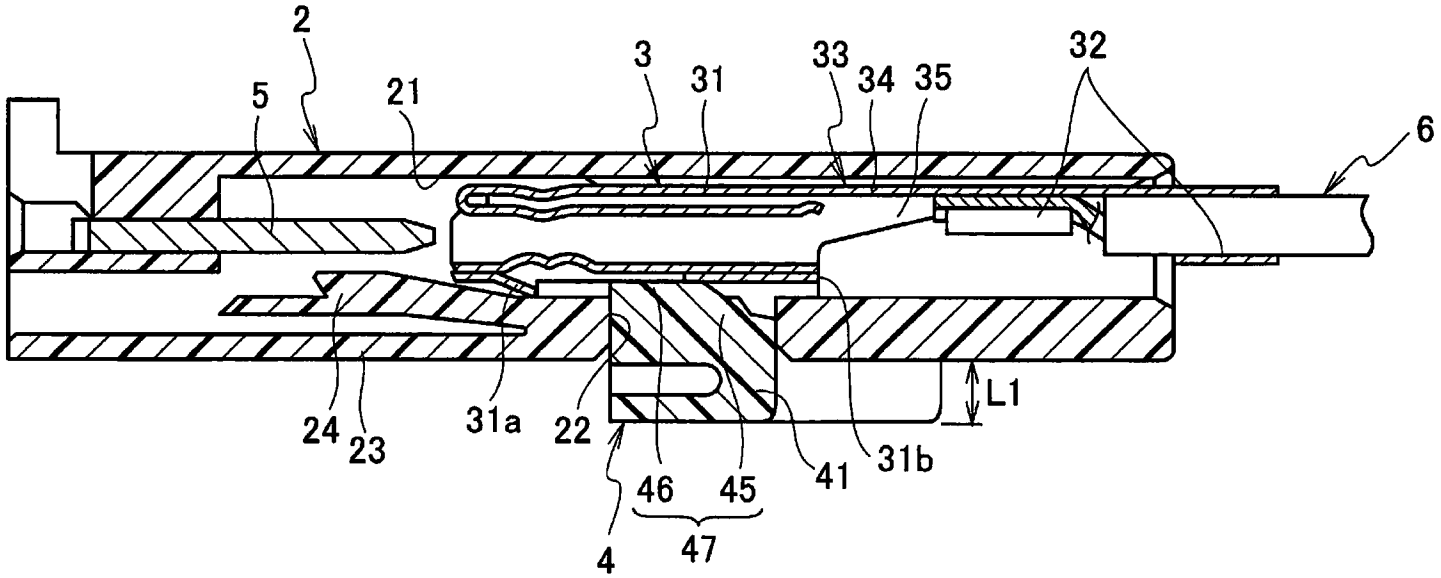
FIG. 5 is a cross-sectional view of the connector when a terminal is in its semi-fit state according to the embodiment of the present invention.
Figure 6A:
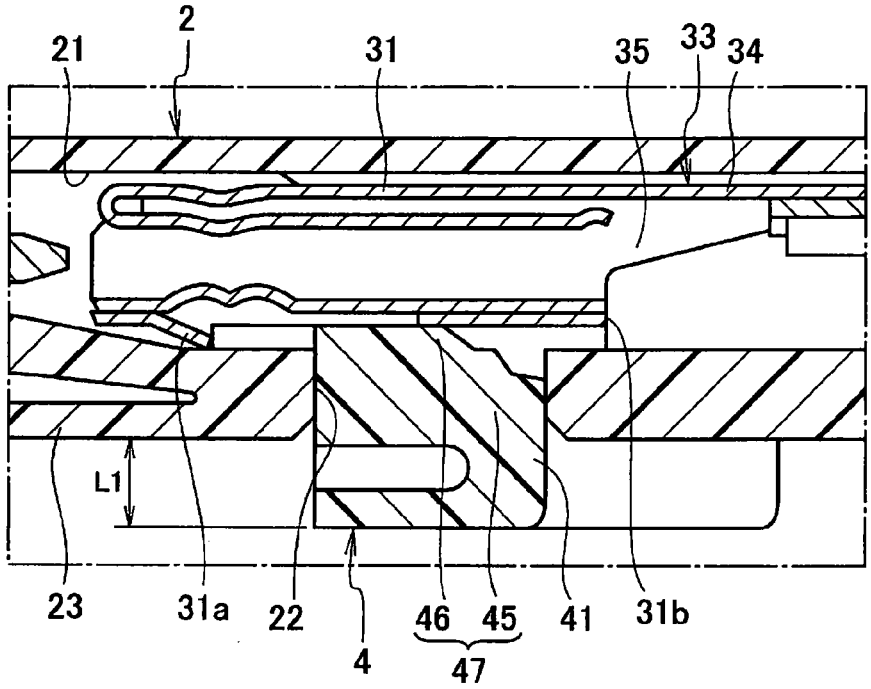
FIG. 6A is an enlarged view of a substantial part of FIG. 5.
Figure 6B:
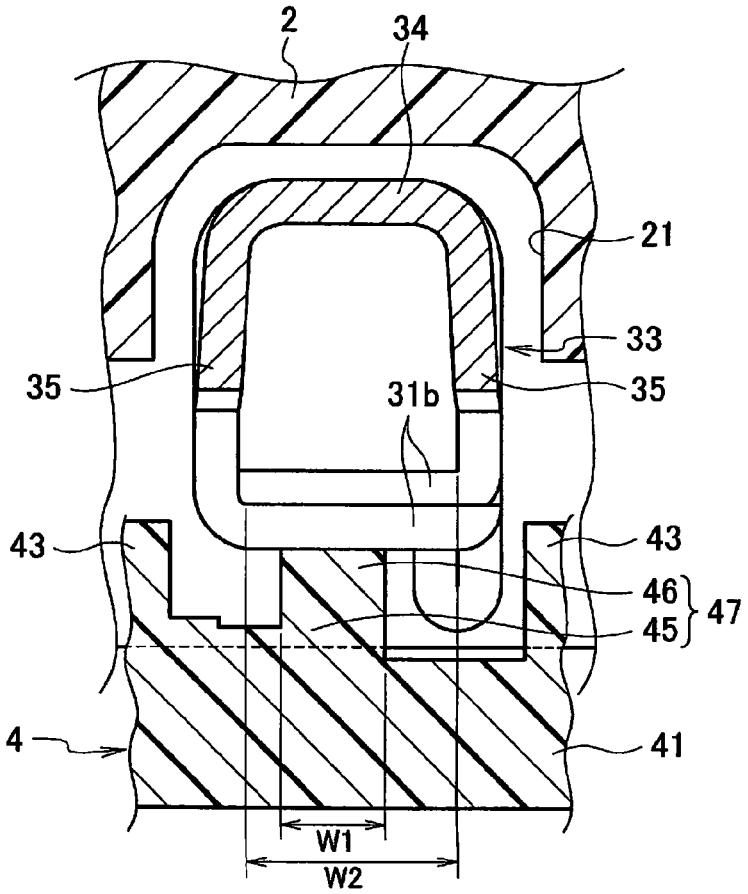
FIG. 6B is a vertical cross-sectional view of FIG. 5.

When the terminal 3 is inserted only in its terminal semi-fit position of the connector housing 2 in the above assembling procedure as shown in FIG. 5 and FIGS. 6A and 6B, the movement of the retainer 4 from the terminal insertion allowable position to the terminal fit position is not allowed and thus the bottom face of the retainer 4 protrudes from the connector housing 2 to an outside.

By the detection of the presence or absence of the protrusion of the retainer 4 after the assembly of the connector 1, the semi-fit state of the terminal 3 is confirmed.

Here, in the terminal fit position, the terminal locking protrusion 47 of the retainer 4 includes the base protrusion 45 coming in contact with the rear wall 31*b* of the opposite terminal connection part 31 of the terminal 3 and the tip end protrusion 46 provided on the enter-side face of the base protrusion 45 and entering the space inside the connection part 33 of the terminal 3. Accordingly, the confirmation of the semi-fit state of the terminal 3 reveals that the protrusion of the retainer 4 is increased by a protrusion amount L1 corresponding to the height of the tip end protrusion 46 of the retainer 4 compared with the related art. Thus, the examination of the semi-fit state of the terminal 3 may be accurately performed based on the position of the retainer 4.

For example, even in a case in which the end of the retainer 4 is rounded, the protrusion amount of the retainer 4 from the connector housing 2 is increased as described above. Therefore, the examination of the semi-fit state of the terminal 3 may be accurately performed. Thus, it is possible to reliably confirm whether the terminal 3 inserted in the connector housing 2 is in the semi-fit state.

Although the embodiments of the present invention has been described above, the invention is not limited to the above embodiment, and various modifications are possible.

This application is based upon and claims the benefit of priority from the prior Japanese Patent Application No. 2012-171928, filed on Aug. 2, 2012, the entire contents of which are incorporated herein by reference.

The invention claimed is:

1. A connector comprising:

a connector housing having a terminal reception chamber and a retainer insertion hole opening into the terminal reception chamber;

a terminal received in a terminal reception chamber by insertion, the terminal having an opposite terminal connection part connected to an opposite terminal, an electric wire connection part connected to an electric wire, and a connection part arranged between the opposite terminal connection part and the electric wire connection part; and a retainer inserted in the retainer insertion hole, having a terminal locking protrusion, and configured to shift between a terminal insertion allowable position and a terminal fit position, wherein the terminal locking protrusion in the terminal insertion allowable position is arranged outside the terminal reception chamber to allow an insertion of the terminal in the terminal reception chamber, wherein the terminal locking protrusion in the terminal fit position protrudes inside the terminal reception chamber and is locked to a rear wall of the opposite terminal connection part of the terminal to prevent a movement of the terminal in a direction opposite to an insertion direction of the terminal, and wherein the terminal locking protrusion has a base protrusion configured to come in contact with the rear wall of the opposite terminal connection part of the terminal with the retainer being in the terminal fit position, and a tip end protrusion provided on an enter-side face of the base protrusion and configured to enter space inside the connection part of the terminal with the retainer being in the terminal fit position.

* * * * *